United States Patent [19]

Pope et al.

[11] 4,220,949

[45] Sep. 2, 1980

[54] ELECTRIC FENCE MONITOR AND ALARM APPARATUS AND METHOD

[75] Inventors: George F. Pope; Evelyn O. Childress, both of Burlington, N.C.

[73] Assignee: Diversified Manufacturing & Marketing Co., Inc., Burlington, N.C.

[21] Appl. No.: 902,526

[22] Filed: May 3, 1978

[51] Int. Cl.[2] ..... G08B 21/00

[52] U.S. Cl. ..... 340/533; 256/10; 340/564; 340/650

[58] Field of Search ..... 340/533, 654, 660, 380, 340/564, 650, 511, 521, 663; 256/10; 250/551; 361/232

[56] References Cited

U.S. PATENT DOCUMENTS

| | | | |
|---|---|---|---|
| 1,913,155 | 6/1933 | Ferguson | 340/654 |
| 2,398,442 | 4/1946 | Moore | 256/10 |
| 2,429,764 | 10/1947 | Moore | 340/650 |
| 2,440,900 | 5/1948 | Heimke | 340/650 |
| 2,450,153 | 9/1948 | Moore | 340/650 |
| 2,971,184 | 2/1961 | Pearson et al. | 340/564 |
| 3,297,913 | 1/1967 | Schweitzer, Jr. | 340/533 |
| 3,496,559 | 2/1970 | Brumfield et al. | 340/650 |
| 3,634,846 | 1/1972 | Fogiel | 340/533 |
| 3,648,266 | 3/1972 | Crist | 340/650 |

FOREIGN PATENT DOCUMENTS

| | | | |
|---|---|---|---|
| 20928 | 3/1905 | Austria | 340/564 |

*Primary Examiner*—John W. Caldwell, Sr.
*Assistant Examiner*—Daniel Myer
*Attorney, Agent, or Firm*—Michael F. Petock

[57] ABSTRACT

An electric fence monitor and alarm apparatus and method is provided in which the charge condition of an electric security fence is continuously monitored, and an indication is provided when the charge on the electric fence falls below a pre-determined level. In a preferred embodiment, the charge on the line causes a circuit to be maintained in an energized condition which maintains a relay or other switch means in a first condition preventing the energization of indicator means or alarm means such as sirens, automatic telephone dialers, horns and bells. When the charge on the line falls below a pre-determined level, the relay or other switch means is switched to a second state, after a pre-determined adjustable time delay, to cause the operation of the indicator, thereby alerting the proper personnel to a failure of the charge on the line for any reason. The failure of the charge on the line is often caused by an unauthorized cutting of the line.

14 Claims, 3 Drawing Figures

ELECTRIC FENCE MONITOR AND ALARM APPARATUS AND METHOD

BACKGROUND OF THE INVENTION

The present invention is directed to an electric fence monitor and alarm apparatus, and the method of monitoring electric fences as disclosed herein. More particularly, the present invention is directed to the method and apparatus of continually monitoring the charge on an electric security fence, and providing an indication when that charge falls below a pre-determined level.

In the past, there was no known means of monitoring whether an electric security fence was properly operating. Electric security fences are widely used to provide a certain degree of security for areas which usually contain valuable property. For example, charged electric fences are usually used around cattle grazing areas to prevent the theft of cattle and around large lumber and supply areas to prevent theft. Electric fences may also be used around minimum security prisons and for many other applications where it is desired to prevent people from passing into or out of an area.

However, a problem exists in the use of charged fences for security purposes in that the fences may be easily cut with a pair of cutting pliers or snips having insulated handles or where the person doing the cutting wears insulating gloves. Unfortunately, such cutting of charged fences and the hauling away of valuable property is not uncommon. The charge on the fence may also be dissipated by a grounding of the charged wire, either intentionally by a potential intruder or accidentially through various occurrences such as something falling on the line. The charged line may also be broken accidentially by something falling on the line, such as a branch from a tree. In all of these cases in the past, the owner of the valuable property and the charged fence did not have any immediate notice of the defective condition of the electric charged fence. In many cases, the cut, broken or defective fence would not be discovered until after the discovery that the valuable property being protected was stolen or by a routine inspection of the fence.

The present invention solves these problems by providing an immediate indication of a loss of charge on the fence either by a cutting, breaking or grounding of the electrically charged fence wire.

SUMMARY OF THE INVENTION

The present invention provides a means and a method of monitoring the charge on the fence and providing an immediate indication of a failure of the charge on the fence.

In accordance with the present invention, the charge on the electric fence wire is continuously monitored and an indication is provided in the case of a failure of the charge on the fence. The indication may be in the form of a siren, horn, bell or the dialing of a telephone number, such as a police telephone number, by automatic dialing equipment in response to the detection of failure of electric charge on the electric fence wire. A delay may be provided to prevent an indication of charge failure or an alarm condition in response to a momentary grounding of the fence wire, such as might occur when a weed or similar object might blow against the electric fence wire. The amount of delay provided may be adjusted to accomodate the particular application. For example, a larger delay might be desirable in an application where the electric fence and the electric fence monitor are used for security purposes to guard against the theft of cattle. Whereas, a shorter time delay may be adjusted into the equipment where the electric fence is used in a paved urban area where it may be desirable for the monitor to indicate an alarm condition shortly after, perhaps within one second, the voltage on the line drops due to a partial grounding by a person touching the charged electric fence wire.

In accordance with the present invention, the apparatus for monitoring the condition of a charged fence includes means for detecting the charge on the fence being monitored and means for providing an indication in response to the charge on the fence being monitored falling below a pre-determined level. Means may be provided for delaying the indication for a pre-determined period of time after the charge on the fence falls below a pre-determined level. The amount of delay may preferrably be adjustable to accomodate various application. The indication provided by the monitoring and alarm apparatus of the present invention may be any suitable type of audible alarm such as a siren, horn, bell or an automatic telephone dialer which may dial a police telephone number or the telephone number of the owner of the valuable property being protected. Preferrably, the monitoring apparatus is connected to the fence at a point farthest removed from the source of the charge on the fence, which is usually a conventional fence charger.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

DETAILED DESCRIPTION OF THE PREFERRED EMBODIMENTS

Figure 1:
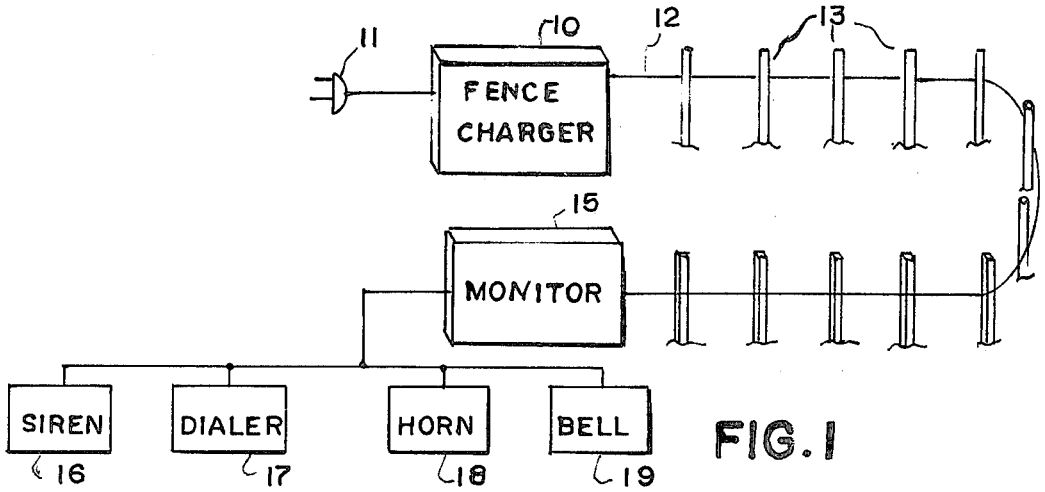
FIG. 1 is a block diagram showing the monitor and alarm apparatus of the present invention connected to an electrically charged fence.

Referring now to the drawings, wherein like numerals indicate like elements, there is shown in FIG. 1 a fence charger 10 which may be connected to a conventional 110–120 volt electrical supply by means of a plug 11. The output of the fence charger is applied to a conductive wire 12 referred to herein as the electrically charged fence wire or line. As is conventional, the electrically charged fence line 12 is not provided with an outer insulating cover, and produces a shock when touched by an unauthorized person. When touched by a person or an animal, a resistance path to ground is formed through the person causing a certain limited current flow through the person producing the shock. The electrically charged fence wire 12 is typically mounted on fence posts as is shown at 13. The output of fence charger 10 may typically be a pulsating voltage having a magnitude in the neighborhood 19,000 volts with a limited current capability, usually somewhere in the neighborhood of one milliampere.

The electric fence monitor 15 of the present invention is connected to charged line 12. The monitor 15 is preferrably connected to the end of line 12 or at a point electrically farthest away from the source of charge, which in this case is the fence charger. Physically, the fence charger 10 and the monitor 15 may be located immediately adjacent to each other, or may actually be incorporated in the same equipment. However, from the electrical point of view, it is preferable to connect the monitor to the opposite end of the line so that any breakage of the line anywhere between the fence charger and the end of the line will be detected. However, it will be understood that the monitor apparatus of the present invention may be connected anywhere on the line and will provide the monitoring function, with the exception that the line being cut at a point electrically beyond the monitor may not be detected. However, the monitor 15 would still detect a grounding of the line at any point as this would ground line 12 resulting in a substantial reduction of the voltage on line 12. Similarly, the cutting of the line at any point may result in a portion of the line touching ground, resulting in a grounding of the line, and therefore the detection of such a fault condition on the line is possible even though the monitor may be located between the output of fence charger 10 and the cut position of the line. In other words, monitor 15 will provide a substantial degree of monitoring protection when it is connected at any point on the line, but preferrably, monitor 15 will be connected to a point on the line which is farthest away from the source of charge produced by fence charger 10.

Figure 2:
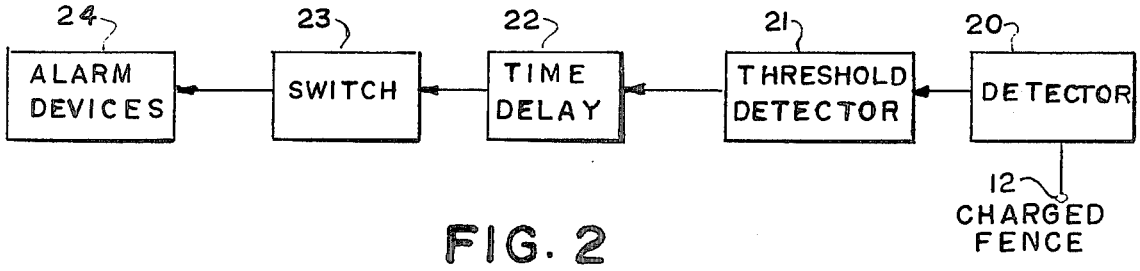
FIG. 2 is a block diagram of an electric fence monitor and alarm apparatus in accordance with the present invention.

The monitor 15 provides an output signal to any one of a number of indicators or alarm devices, such as those shown in FIG. 1. For example, monitor 15, upon the detection of a drop in the charge or voltage on line 12, will cause the energization of siren 16, automatic telephone dialer 17, horn 18 and/or bell 19. A general block diagram of the structure of the monitor and alarm apparatus of the present invention is shown in FIG. 2. Detector 20 monitors or detects the charge or voltage on line 12. The output of detector 20 is supplied to a threshold detector 21. It is understood that detector 20 may be comprised of any suitable type of detection means, including a resistive connection directly to the line. Alternatively, detector 20 may be comprised of a magnetic coupling circuit which would detect the pulsating voltage and current on line 12, or any other suitable type of detection means. Threshold detector 21 may be used to detect when the voltage on the line falls below a predetermined value. Preferrably, a threshold detector may be used so that an alarm or indicator device may be energized eventhough the voltage or charge on the line is only cut in half, still leaving a substantial charge on the line. In certain applications, threshold detector 21 and detector 20 may be combined, such as in the case where a high voltage breakdown device is connected directly to the line.

The output of threshold detector 21 is fed to a time delay means or time delay circuit 22. Preferably time delay circuit 22 is adjustable as to the length of delay. In certain applications, it may be desirable to set the time delay for as long as 10 seconds. In otherwords, the line would have to remain shorted or broken for 10 seconds before an alarm would be sounded. This might be desirable in applications where there might be an occassional touching of the line by objects blowing onto the line or other similar incidents in order to prevent or substantially reduce any incidence of false alarms. In other applications, such as perhaps a situation where an electrically charged fence may be used as an aid to maintain prisoners in a minimum security prison, it may be desirable that an alarm be sounded within one-half second or one second of a momentary grounding as such a grounding might indicate that a prisoner is attempting to scale the fence. In any event, it is desirable to have an adjustable time delay means to adjust the time delay for the particular application.

The output of the time delay means is fed to a switch means 23 for controlling the alarm devices 24. Switch means 23 may be any suitable type of switching means. For example, switch means 23 may be a relay controlled by a switching solid state device. Alternatively, switch 23 may be a high current solid state switching device which would directly switch the current on or off to the alarm devices. Various other types of electrically contolled switch means may be used for switch 23.

The alarm devices 24 may be any suitable type of alarm or indicator device, audible, visual or other suitable types. As discussed previously with respect to FIG. 1, the alarm devices 24 may be a siren, horn and/or bell. All of these may be used together or one or more may be selected to be used. In addition, the output of the monitor may be used to energize an automatic telephone dialer which would dial any desired number, such as the owner of the property or a local police department. The dialer could be equipped with a pre-recorded message stating that a failure in the fence has been detected and that the premises should be checked immediately. In the case of a dialer set to dial the local police department, the address of the property could also be provided on the pre-recorded message.

Figure 3:
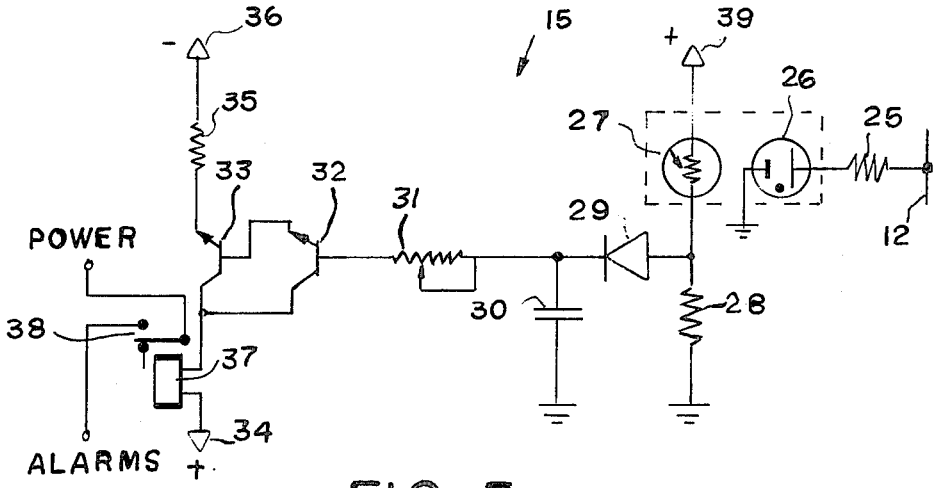
FIG. 3 is a schematic diagram of an electric fence monitor apparatus in accordance with the present invention.

Referring now to FIG. 3, there is shown a schematic diagram of a presently preferred embodiment of the present invention. However, it is understood that although this is a presently preferred embodiment of the monitor 15, that it is apparent that various changes may be made in the circuit arrangement and different components may be substituted for the components illustrated. As shown in FIG. 3, the monitor apparatus 15 is connected to the charged fence line 12 through a resistor 25. Resistor 25 may preferrably have a value of 5 megohms. However, it is understood that all of the values of components given herein are only by way of example, and are in no way intended to be limiting. A neon bulb 26 may be connected between resistor 25 and ground. Mounted in close proximity to neon bulb 26 is a photo-resistor device 27 which receives light emitted by neon bulb 26. When neon bulb 26 is energized or lit, the light from neon bulb 26 causes a reduction in the terminal resistance of photo-resistor 27. Preferrably, the neon bulb 26 and the photo-resistor 27 may be purchased as a package which is sometimes referred to in the art as an "isolating photo-cell".

One terminal of photo-resistor or photo-cell 27 is connected to a positive supply voltage 39. The positive supply voltage 39 may be a positive 6 volts. The other terminal of photo-resistor 27 is connected through resistor 28 to ground. The junction of photo-resistor 27 and resistor 28 is connected to diode 29. The opposite terminal of diode 29 is connected to the junction of capacitor 30, connected to ground,and a variable resistance 31, which may preferrably be in the form of a rheostat. By way of example, and not by way of limitation, resistor 28 may be 2200 ohms, diode 29 may be an IN 914, capacitor 30 may be 47 microfarads and rheostat 31 may preferrably have a maximum value of 47,000 ohms.

Rheostat 31 and capacitor 30 form a variable time delay circuit.

The base of transistor 32 receives the signal voltage from variable resistor 31. Transistor 32 is connected with transistor 33 to form a fast and reliable switching transistor circuit as is known in the art. However, it is understood that a single switching transistor or other solid state switching device may be used in place of transistors 32 and 33. A relay coil is connected in the collector circuits of transistors 33 and 32 between the collectors and a positive supply of voltage 34. The positive supply of voltage 34 may be a positive 6 volts. The emitter of transistor 33 is connected through a resistor 35 to a negative supply voltage 36 which may be a negative 6 volts.

Relay coil 37 controls relay contacts 38. Relay contacts 38 control the energization of the alarm devices such as the siren and automatic telephone dialer. When a fault is detected on line 12 by reason of a shorting of line 12 to ground or an opening of the line, with the resultant loss of the pulsating voltage on the line, relay contacts 38 cause power to be applied to the various alarms thereby energizing the alarms. For example, relay contacts 38 may be normally closed contacts which are held open so long as the proper voltage is detected on line 12. When a fault occurs, relay contacts 38 are allowed to close causing an alarm to be energized. In this manner, any failure of the circuit will automatically produce an alarm condition.

In operation, the pulsating voltage on line 12 is applied through resistor 25 to energize neon bulb 26 when a proper and sufficient amount of voltage above a predetermined minimum is detected on line 12. The energization of neon bulb 26 causes a reduction in the resistance of photo-resistor 27. A positive potential is applied through diode 29 and the time delay circuit comprised of resistance 31 and capacitor 30 to switching transistors 32 and 33. The positive potential applied to the base of switching transistor 32 maintains relay coil 37 in an energized state thereby holding relay contacts 38 open. As long as relay contacts 38 are held open, an alarm is not sounded nor energized.

If a failure occurs on line 12, which results in a reduction in the charge, whether by grounding or an opening of the line, neon bulb 26 will be extinguished causing an increase in the resistance of photo-resistor 27. The reduction in the positive potential, after passing through the timed delay caused by resistance 31 and capacitor 30, is applied to the base of transistor 32. This results in a de-energization of relay coil 37 causing relay contacts 38 to assume their normally closed position resulting in power being applied to the alarms with a resulting alarm condition being indicated.

The rapidity at which an alarm is sounded after a fault occurs on line 12 is adjusted by adjusting rheostat 31 in the time delay circuit.

In accordance with the present invention, a new and unobvious method of providing additional security is obtained by monitoring the charge or voltage on an electric fence line and providing an indication of a failure of a charge on the fence. This method may be modified by providing an adjustable delay between the detection of a failure on the line and the providing of an indication of the alarm condition. The method of the present invention may also be enhanced by the use of a telephone dialer with a pre-recorded message which may be used to immediately alert a local police department of the alarm condition.

The present invention may be embodied in other specific forms without departing from the spirit or essential attributes thereof and, accordingly, reference should be made to the appended claims, rather than to the foregoing specification as indicating the scope of the invention.

We claim:

1. Apparatus for monitoring the condition of a charged pulsating high voltage fence, comprising:

means for detecting the charge on the fence being monitored and providing a signal in response to the charge falling below a pre-determined level, said detecting means including a voltage breakdown device;

means for delaying said signal thereby delaying the indication of the charge on the fence falling below a pre-determined level;

means for delaying said signal thereby delaying the indication of the charge on the fence falling below a pre-determined level; and said indicator means including an automatic telephone dialer which is operative in response to said delayed signal.

2. Apparatus in accordance with claim 1 wherein said delay means is adjustable.

3. Apparatus in accordance with claim 2 wherein said adjustable delay means is comprised of a variable resistance and a capacitor connected in a resistance-capacitance timing circuit.

4. Apparatus in accordance with claim 1 wherein said indicator means includes an audible alarm.

5. Apparatus in accordance with claim 4 wherein said audible alarm includes a siren.

6. Apparatus in accordance with claim 4 wherein said audible alarm includes a horn.

7. Apparatus in accordance with claim 4 wherein said audible alarm includes a bell.

8. Apparatus in accordance with claim 1 wherein said detecting means is connected to said electrically charged fence at a point electrically farthest removed from the source of charge on the fence.

9. An apparatus in accordance with claim 1 wherein said automatic telephone dialer of said indicator means is provided with a pre-recorded message which is automatically played after the automatic dialing of a predetermined telephone number.

10. A method comprising the steps of:

monitoring the charge on an electrically charged pulsating high voltage fence and providing a signal when the charge on the fence falls below a predetermined value, said signal being generated by means of a change in condition of a voltage breakdown device; and providing in response to said signal an indication of a failure of a charge on the fence when the charge on the fence falls below a pre-determined level;

delaying said signal thereby delaying the providing of an indication of a failure of the charge on the fence; and providing automatic telephone dialing equipment operative in response to said delayed signal.

11. A method in accordance with claim 10 including the step of adjusting the amount of delay.

12. A method in accordance with claim 10 wherein said step of providing an indication includes the step of providing an audible alarm.

13. A method in accordance with claim 10 including the step of connecting detecting means for monitoring the charge on the electric fence to a point on the fence which is electrically farthest removed from the source of charge on the fence.

14. A method in accordance with claim 10 including the step of providing a pre-recorded message which is played over the telephone in response to the operation of said automatic telephone dialing equipment.

* * * * *